US008129892B2

(12) United States Patent
Inoue

(10) Patent No.: US 8,129,892 B2
(45) Date of Patent: Mar. 6, 2012

(54) LIGHT EMITTER SUBSTRATE AND IMAGE DISPLAYING APPARATUS USING THE SAME

(75) Inventor: Yukihiro Inoue, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 12/482,854

(22) Filed: Jun. 11, 2009

(65) Prior Publication Data

US 2009/0309480 A1 Dec. 17, 2009

(30) Foreign Application Priority Data

Jun. 16, 2008 (JP) ..... 2008-156665

(51) Int. Cl.
*H01J 29/08* (2006.01)
*H01J 1/62* (2006.01)

(52) U.S. Cl. ..... 313/473; 313/495; 313/497

(58) Field of Classification Search ..... 313/463, 313/461, 473, 495–497
See application file for complete search history.

(56) References Cited

U.S. PATENT DOCUMENTS

| | | | | |
|---|---|---|---|---|
| 7,944,136 | B2 * | 5/2011 | Inoue | 313/495 |
| 2006/0103294 | A1 * | 5/2006 | Suzuki et al. | 313/496 |
| 2007/0257599 | A1 | 11/2007 | Sato et al. | 313/495 |
| 2009/0184658 | A1 | 7/2009 | Inoue et al. | 315/291 |
| 2009/0302735 | A1 | 12/2009 | Yamazaki et al. | 313/307 |
| 2009/0310360 | A1 | 12/2009 | Inoue | 362/249.01 |

FOREIGN PATENT DOCUMENTS

| | | |
|---|---|---|
| EP | 1 830 379 A1 | 9/2007 |
| JP | 2006-173094 A | 6/2006 |
| JP | 2006-185632 A | 7/2006 |

* cited by examiner

*Primary Examiner* — Joseph L Williams
*Assistant Examiner* — Nathaniel Lee
(74) *Attorney, Agent, or Firm* — Fitzpatrick, Cella, Harper & Scinto

(57) ABSTRACT

In a light emitter substrate which has a resistor for connecting electrodes adjacent in a row direction, it aims to improve withstand discharge performance of the resistor. In the substrate comprising a substrate, plural light emitting members which are positioned in matrix on the substrate, plural electrodes each of which covers at least one of the light emitting members and which are positioned in matrix, and a row-direction striped resistor which is positioned between the electrodes adjacent in a column direction and connects the electrodes adjacent in a row direction and the column direction, a row-direction separated distance Gx' between the electrodes adjacent in the row direction at a connecting portion between the electrodes and the resistor is made larger than a row-direction separated distance Gx between the electrodes adjacent in the row direction at a portion covering the light emitting members (Gx'>Gx).

2 Claims, 4 Drawing Sheets

LIGHT EMITTER SUBSTRATE AND IMAGE DISPLAYING APPARATUS USING THE SAME

BACKGROUND OF THE INVENTION

1. Field of the Invention

The present invention relates to a light emitter substrate and an image displaying apparatus which uses the light emitter substrate.

2. Description of the Related Art

Conventionally, an image displaying apparatus which comprises a rear plate substrate having plural electron-emitting devices arranged in matrix and a light emitter substrate having plural light emitting members arranged in matrix and opposed to the plural electron-emitting devices has been known. In the image displaying apparatus like this, the light emitter substrate and the rear plate substrate are typically opposed to each other at a gap of about several millimeters, and high voltage of, e.g., approximately 10 kV is applied between these substrates. For these reasons, a discharge occurs easily, and, if the discharge once occurs, a discharging current flows from the whole of a metal back which has been integrally formed, whereby an influence to the electron-emitting devices expands.

Consequently, in order to allow the image displaying apparatus of the above type to have a discharging current control function, Japanese Patent Application Laid-Open No. 2006-173094 corresponding to U.S. Patent Application Publication No. US-2006-0103294 (called a patent document 1 hereinafter) and Japanese Patent Application Laid-Open No. 2006-185632 corresponding to European Patent Application Publication EP-A-11830379 (called a patent document 2 hereinafter) respectively disclose techniques for controlling a discharging current by two-dimensionally dividing a metal back and establishing a connection between the divided metal backs by a resistor.

However, if a discharge occurs in a case where further high voltage is applied to improve luminance, a potential difference between the adjacent metal backs increases, whereby there is a possibility that a secondary discharge occurs between the adjacent metal backs. Besides, if the resistor is arranged between the adjacent metal backs, withstand voltage of a material of the resistor is lower than surface withstand voltage between the metal backs according to a kind of the relevant material, whereby there is a possibility that withstand discharge structure is destroyed. In particular, in an ordinary image displaying apparatus to be used for a TV monitor, since a distance between the metal backs adjacent in a horizontal direction (=a row direction) is small, the secondary discharge occurs easily. If the secondary discharge occurs, the discharging current increases, whereby there is a possibility that a damage such as device destruction or the like which is not preferable for image displaying occurs.

To cope with such a problem as described above, in the patent document 1 and the patent document 2, it is designed to define resistance in the row direction without arranging any resistor between light emitting members adjacent in the row direction. More specifically, the patent document 1 discloses the structure that the metal back divided in matrix and the resistors patterned in matrix are combined, and any resistor is not arranged between the metal backs adjacent in the row direction. Further, the patent document 2 discloses the structure that the metal backs divided in matrix and striped resistors expanding in the row direction between the metal backs adjacent in a column direction are connected on the column side of the light emitting members.

However, in the light emitter substrate disclosed in the patent document 1, further improvement is desired in the points of definition of the resistance of the resistor and the withstand voltage of the material. Also, in the light emitter substrate disclosed in the patent document 2, structure of further weakening field intensity applied to the resistor by controlling the secondary discharge between the metal backs adjacent in the row direction is desired.

SUMMARY OF THE INVENTION

The present invention aims to improve, in a light emitter substrate which has a resistor for connecting electrodes adjacent in a row direction, withstand discharge performance of the resistor. Moreover, the present invention aims to provide an image displaying apparatus which uses the light emitter substrate like this.

A light emitter substrate according to one aspect of the present invention is characterized by comprising a substrate, plural light emitting members which are positioned in matrix on the substrate, plural electrodes each of which covers at least one of the light emitting members and which are positioned in matrix, and a row-direction striped resistor which is positioned between the electrodes adjacent to each other in a column direction and connects the electrodes adjacent to others in a row direction and the column direction. Here, a row-direction separated distance between the electrodes adjacent to each other in the row direction at a connecting portion between the electrodes and the resistor is made larger than a row-direction separated distance between the electrodes adjacent to each other in the row direction at a portion covering the light emitting members.

Moreover, an image displaying apparatus according to another aspect of the present invention is characterized by comprising: a rear plate substrate having plural electron-emitting devices; and the above-described light emitter substrate, wherein the light emitting members of the light emitter substrate emit light in response to electrons emitted from the electron-emitting devices.

According to the present invention, in the light emitter substrate which has the resistor for connecting the electrodes adjacent in the row direction, it is possible to improve the withstand discharge performance of the resistor. Moreover, according to the present invention, it is possible to provide the image displaying apparatus which uses the light emitter substrate like this.

Further features of the present invention will become apparent from the following description of the exemplary embodiments with reference to the attached drawings.

DESCRIPTION OF THE EMBODIMENTS

Figure 1:
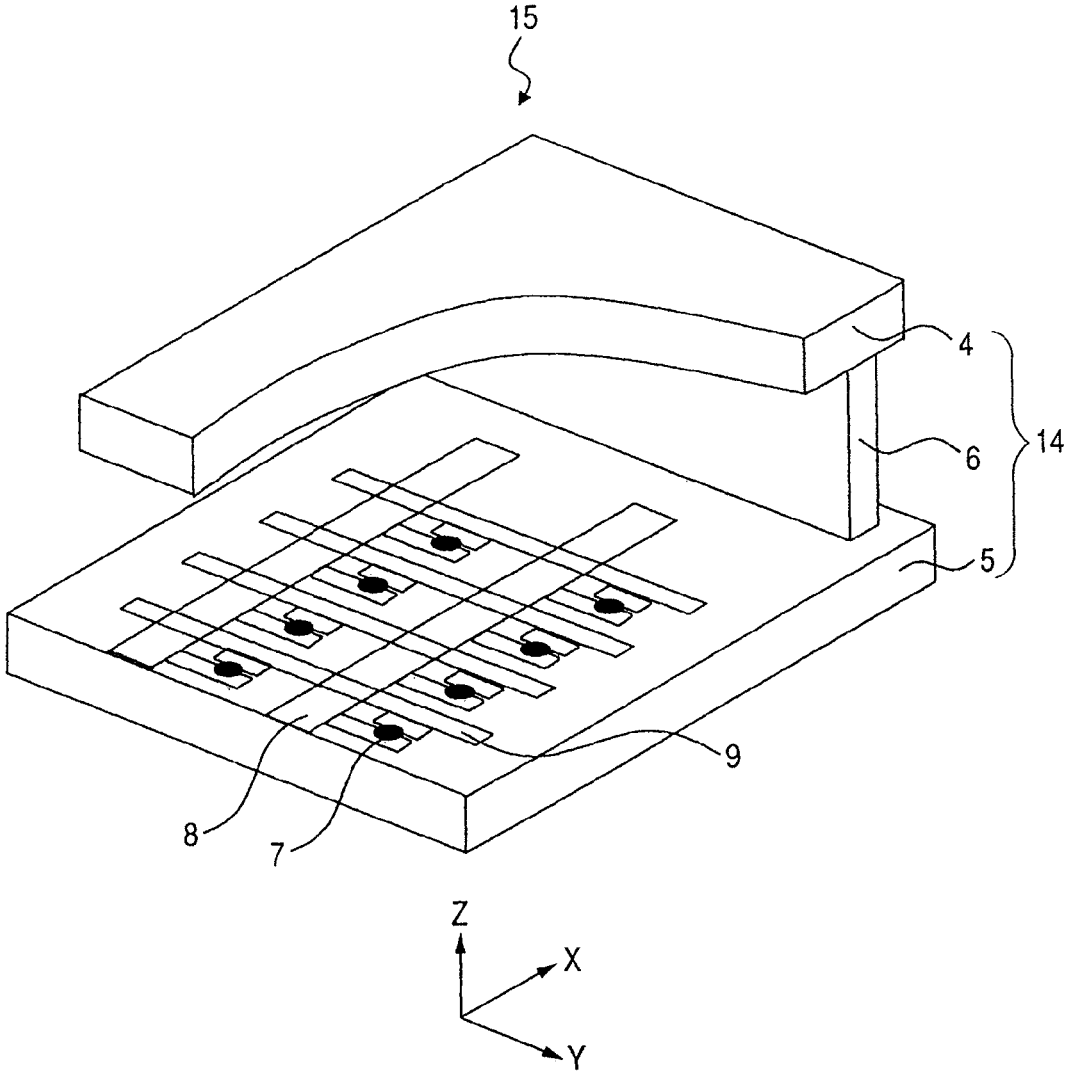
FIG. 1 is a partial fractured perspective view of an image displaying apparatus according to an embodiment of the present invention.

Hereinafter, the exemplary embodiments of the present invention will be described with reference to the attached drawings.

First, the basic structure of an image displaying apparatus according to an embodiment of the present invention will be described with reference to FIG. 1. An image displaying apparatus 15 has a light emitter substrate 4 and a rear substrate 5 respectively composed of rectangular shaped glasses, and both the substrates 4 and 5 are oppositely arranged having a distance of about 1 mm to 2 mm. Marginal edges of the light emitter substrate 4 and the rear substrate 5 are bonded each other due to the interposition of a side wall 6 in a rectangular frame shape to constitute a flattened rectangular shaped vacuum envelope 14 of which the inside is maintained to become a high vacuum having a level equal to or less than $10^{-4}$ Pa.

A large number of electron-emitting devices 7 for emitting an electron beam used for exciting light emitting members 1 to be described later are provided on the internal surface of the rear substrate 5. These electron-emitting devices, which are arranged in matrix to have plural rows and plural columns corresponding to the light emitting members 1, are driven by a driving circuit (not illustrated) outside the vacuum envelope 14 through row-direction wirings 8 and column-direction wirings 9 arranged in matrix. The image displaying apparatus 15 is constituted by adding not-illustrated power supply, driving circuit and the like to the vacuum envelope 14.

Figure 2:
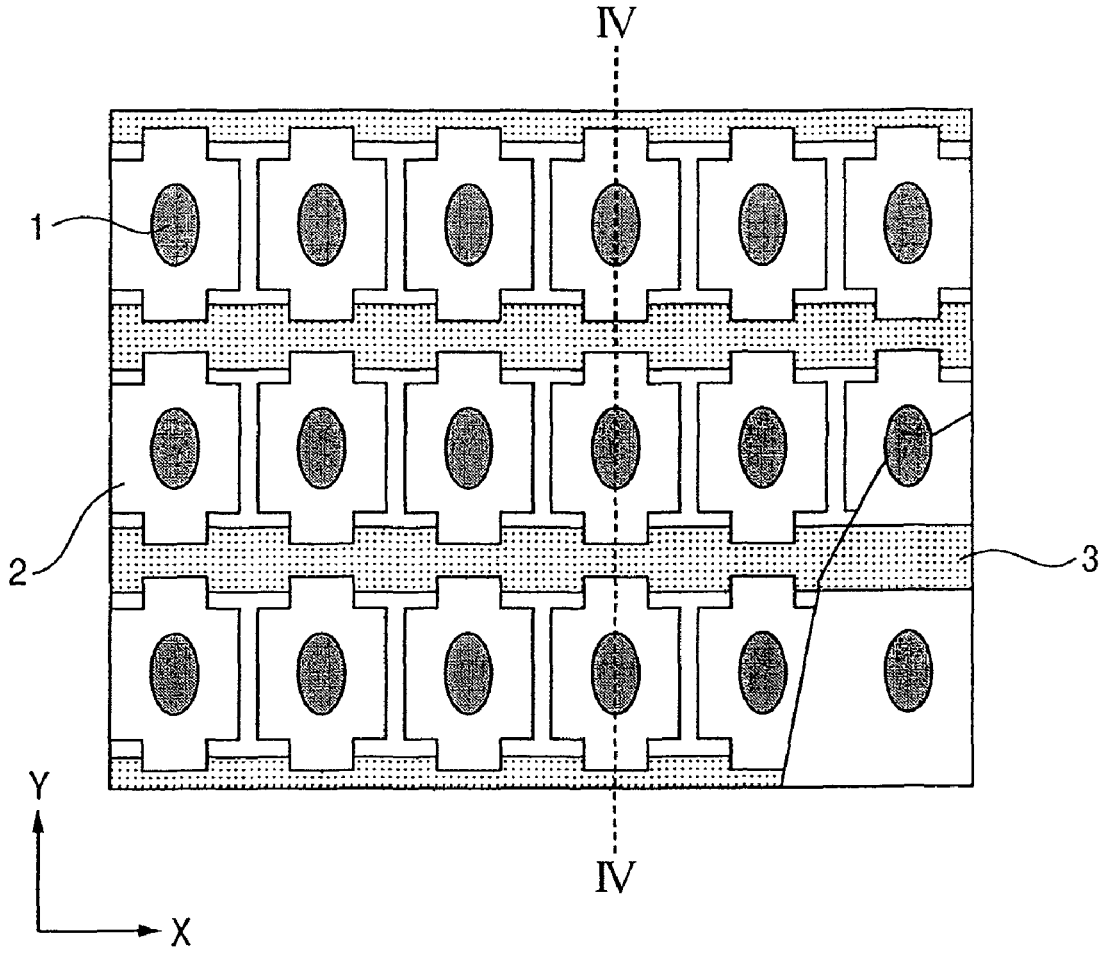
FIG. 2 is an internal plan view of a light emitter substrate in the image displaying apparatus illustrated in FIG. 1.
Figure 3:
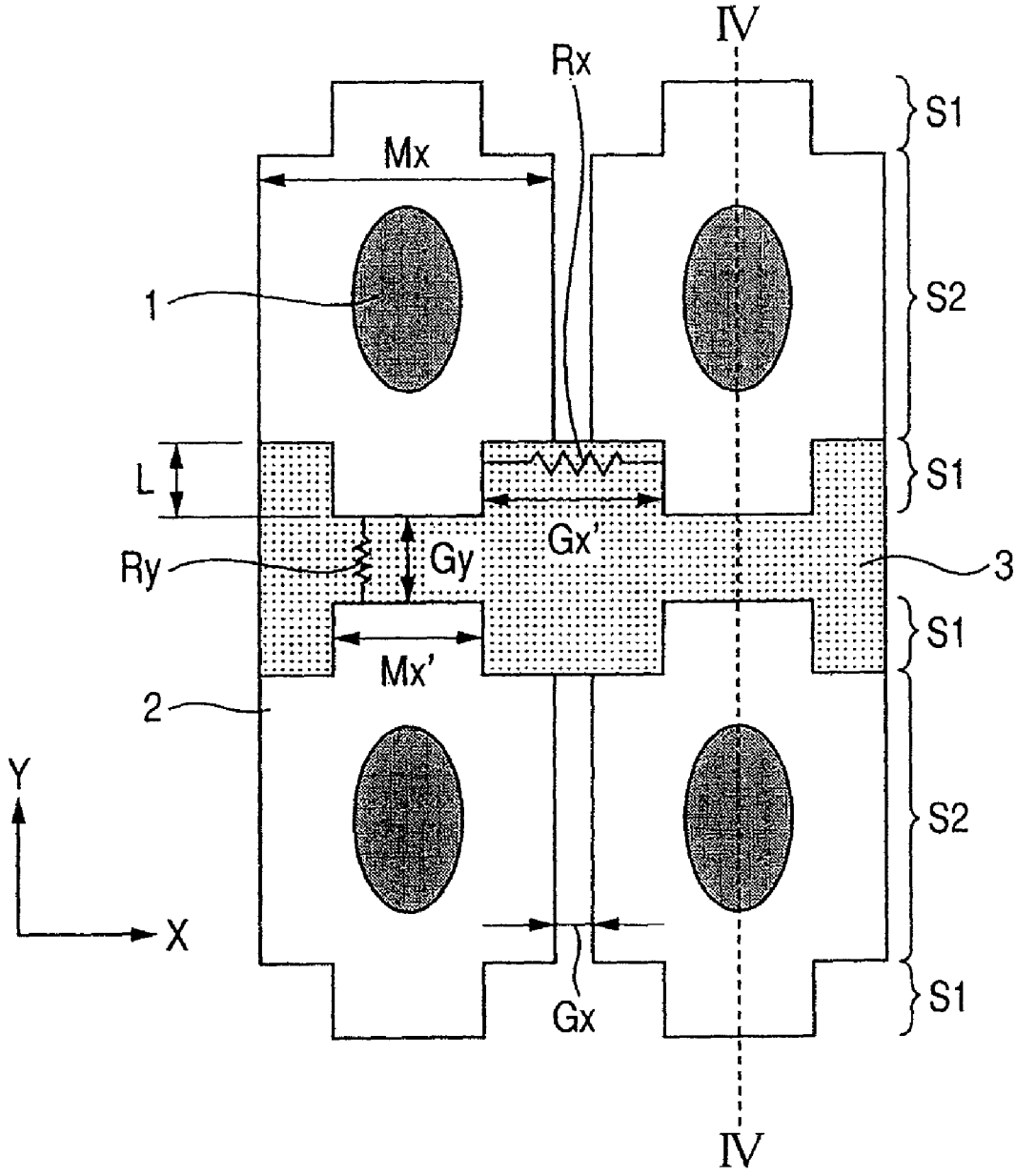
FIG. 3 is a partial enlarged view of FIG. 2.
Figure 4:
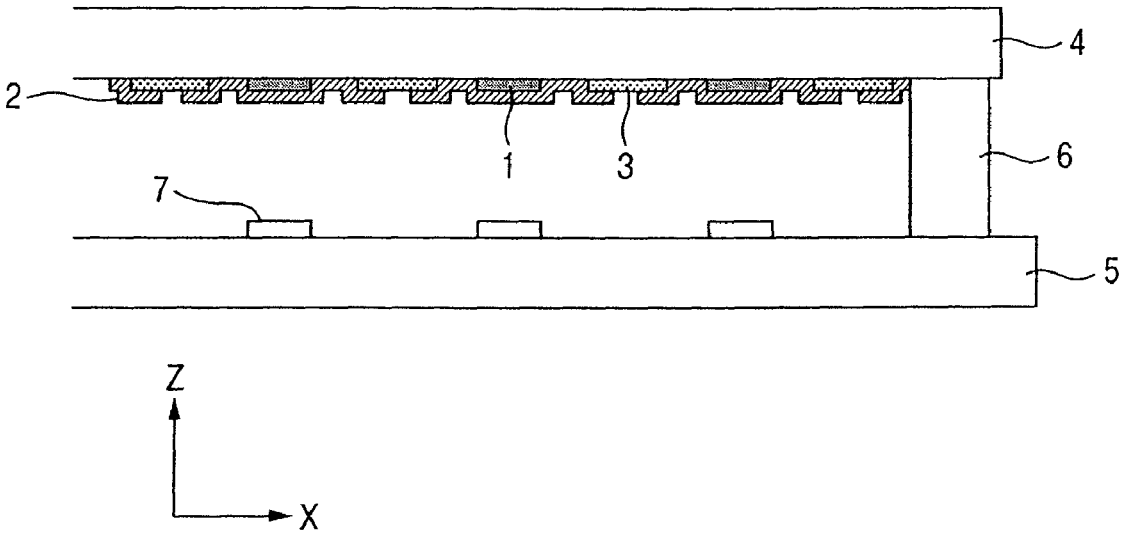
FIG. 4 is a cross-sectional view along the line IV-IV indicated in FIGS. 2 and 3.

FIG. 2 is an internal plan view of the light emitter substrate in the image displaying apparatus illustrated in FIG. 1, FIG. 3 is a partial enlarged view of FIG. 2, and FIG. 4 is a cross-sectional view of the image displaying apparatus illustrated in FIG. 1 along the line IV-IV indicated in FIGS. 2 and 3. A right lower part in FIG. 2 indicates a state of stripping off a metal back (that is, a state that a light emitting member and a resistor are exposed). In a region other than the right lower part in FIG. 2 or in FIG. 3, although the light emitting members 1 are specifically illustrated in order to understand the positional relationship in the X and Y directions between the light emitting members 1 and metal back layers (electrodes) 2 functioning as anode electrodes, the light emitting members 1 are actually covered and hidden by the metal back layers 2 (refer to FIG. 4). The constitution of the light emitter substrate 4 will be described with reference to these drawings.

The light emitting members 1 consisted of a large number of phosphors of emitting lights in red (R), green (G) and blue (B) are positioned on the internal surface of the light emitter substrate 4. The image displaying apparatus 15 of the present embodiment is typically an image displaying apparatus of having a horizontally long screen, and when it is assumed that a long axis direction is an X direction (row direction) and a short axis direction is a Y direction (column direction), the light emitting members 1 are arrayed in matrix with predetermined pitches in the X direction (row direction) and the Y direction (column direction). The phosphors of R, G and B are repeatedly arranged in the X direction (row direction). Here, the "predetermined pitches" includes a case of varying the array pitches within a range of error on a manufacturing process or a case of varying the array pitches due to a cause in design. The light emitting members 1 can be formed by the application by using a precipitation method, a screen printing method, a dispenser method or the like regardless of monochrome or color.

The metal back layers (electrodes) 2 functioning as the anode electrodes are formed on the light emitting members 1. The metal back layers 2 are separated each other in the X direction (row direction) and the Y direction (column direction). That is, in the present embodiment, the one metal back layer 2 corresponds to the one light emitting member 1, and each of the metal back layers 2 covers the corresponding light emitting member 1 from the internal surface side of the image displaying apparatus 15. The metal back layers 2 are formed on almost the whole area of the substrate on which the light emitting members 1 were formed. The metal back layers 2 can be formed by using a method of performing the patterning by the photo etching (a photolithography method). Alternatively, the metal back layers 2 may be formed also by a method of performing a vacuum vapor deposition by using a metal mask having predetermined apertures as a shielding member (mask vapor deposition).

A resistor 3, which continuously extends in the X direction (row direction), is provided between the metal back layers 2 (between the electrodes) adjacent to each other in the Y direction (column direction). The resistors 3 have a stripe shape having constant width in the Y direction (column direction) as illustrated in a right lower part in FIG. 2. The resistors 3 can be formed by a photolithography method, a screen printing method or a dispenser method.

When referring to FIG. 3, the metal back layer 2 is formed in such a way as to cover the resistor 3, that is, to be put on the resistor 3 at a connecting portion S1 to be connected with the resistor 3. As a result, the metal back layer 2 electrically connects the metal back layers 2 adjacent to each other in the X direction (row direction) and the metal back layers 2 adjacent to each other in the Y direction (column direction). In FIG. 3, it is schematically illustrated that a resistance Rx is formed between the metal back layers 2 adjacent to each other in the row direction and a resistance Ry is formed between the metal back layers 2 adjacent to each other in the column direction.

The anode potential is supplied to the resistor 3 from a high-voltage power source (not illustrated) provided in the image displaying apparatus 15. Therefore, the metal back layer 2 is set to become the anode potential through the resistor 3, and an electron beam emitted from the electron-emitting devices 7 is accelerated by the anode potential to collide with the light emitting members 1, and an image is displayed.

The metal back layer 2 is formed such that a width Mx in the X direction (row direction) at a portion S2 of covering the light emitting member 1 is wider than a width Mx' in the X direction (row direction) at the connecting portion S1 to be connected with the resistor 3. As a result, a separated distance Gx' in the row direction between the metal back layers 2 adjacent to each other in the X direction (row direction) at the connecting portion S1 to be connected with the resistor becomes longer than a separated distance Gx in the row direction between the metal back layers 2 adjacent to each other in the X direction (row direction) at the portion S2 of covering the light emitting member. According to this constitution, the separated distance between the end portions of the metal back layers 2 adjacent to each other in the X direction (row direction) can be secured to become long, and the resistance Rx can be substantially set to become large. In other words, when the discharge occurs between a certain metal back and the electron-emitting device, although electrons are flown in from the adjacent metal backs through the resistor 3, the length of the resistor 3 in the row direction can be easily secured by keeping the separated distance Gx' between the metal backs to become long at the connecting portion S1 to be connected with the resistor 3. Herewith, the resistor 3 can easily withstand the potential difference between the adjacent metal backs 2, and the anode electrode voltage can be more increased to a high level. Therefore, a light emitter substrate capable of displaying a high-luminance image can be obtained. Note that the separated distance Gx between the metal backs 2 can be arbitrarily selected in accordance with the discharge current specification or convenience on a matter of process.

Since the number of arrays of the light emitting members in the column direction is limited by the number of scanning lines, a separated distance Gy between the metal back layers 2 in the column direction sometimes becomes longer than the separated distance Gx in the row direction depending on the embodiment. In this case, although the resistance Ry becomes a large value, the separated distance Gy between the metal back layers 2 adjacent to each other in the column direction can be narrowed and the resistance Ry can be decreased by prolonging the end portion, that is, keeping the length in the Y direction (column direction) at the connecting portion S1 to become long.

In the present embodiment, the discharge voltage between the adjacent metal back layers 2 is determined by the separated distance Gx' between the metal backs at the connecting portion S1. If each of the metal back layers 2 has a rectangular shape and the separated distance Gx' is equal to the separated distance Gx at the portion S2 of covering the light emitting member 1, it is required that the resistance Rx is strictly adjusted by a high-precision pattern forming of the resistor 3 or the separating application of the resistor. However, since the separated distance Gx' is longer than the separated distance Gx, an influence given by the formation accuracy of the resistor 3 to the resistance Rx is reduced, and the high-precision pattern forming of the resistor 3 is not required. Moreover, since the separated distance Gx' can be determined independently of the array pitches of the light emitting members 1, a degree of freedom in adjustment is also a large degree. Furthermore, as for the resistor 3, since a film which extends in the X direction (row direction) with a constant width has only to be formed, a manufacturing process is also simplified.

EXAMPLE

The light emitter substrate having the constitution illustrated in FIGS. 2 to 4 was manufactured by the following process. As a glass substrate, a glass substrate of which thickness is 2.8 mm (PD 200 produced by Asahi Glass Co., Ltd.) is used, and the NP-7803D (produced by Noritake Kizai Co., Ltd.) was formed on the PD 200 as a light shielding layer. Next, after the light emitting members 1 of R, G and B were applied and baked, the striped resistors 3 which extend in the row direction were formed by a dispenser method. Additionally, the metal back layers 2 were formed on the light emitting members 1 by a photolithography method.

In this example, it was purposed that a discharge current between an anode electrode and an electron-emitting device is reduced to a level equal to or less than 1 A, a secondary discharge due to the potential difference to be occurred when the discharge occurred between the separated metal back layers 2 is prevented and the luminance deterioration is made to reach an acceptable level by suppressing the anode potential drop at a time of driving to a level equal to or less than 250V. For this purpose, it is required to execute a manufacturing process with the resistance of Rx=367 kΩ and Ry=250 kΩ. These values were calculated by previously performing a calculation in an equivalent circuit model in which resistance, capacity, inductance and the like are two dimensionally linked. Required resistance values of the Rx and the Ry can be obtained by performing a calculation by previously planning the equivalent circuit model in accordance with the discharge current to be obtained, the potential difference occurred between the adjacent metal backs and the luminance deterioration amount at a time of driving.

In this example, aluminum (Al) is used as the metal back layers 2, and the resistance values of Rx=367 kΩ and Ry=250 kΩ were realized. More specifically, the width Mx in the row direction of the metal back layer 2 was formed with a width of 160 μm and the width (Mx') in the row direction of the end portion was formed with a width of 100 μm (refer to FIG. 3). In addition, the separated distance (Gx) between the metal back layers 2 adjacent to each other in the row direction was formed with a distance of 50 μm and the separated distance (Gy) between the metal back layers 2 adjacent to each other in the column direction was formed with a distance of 50 μm. Additionally, the resistive material, of which the volume resistance is 5 Ω·m, is used as the resistor 3, and the width in the column direction of the resistor 3 was formed with a width of 200 μm and the film thickness was formed with a thickness of 100 μm. The separated distance (Gx') between the end portions of the metal back layers 2 adjacent to each other in the row direction becomes 110 μm. In this example, since the resistor 3 is formed at the end portion where the width of the metal back layer 2 becomes a narrow width, the resistance values of the Rx and the Ry are defined by a width and a length of the end portion and a distance between the end portions of the adjacent metal back layers 2.

$$Rx=5\ \Omega\cdot m/10\ \mu m\times 110\ \mu m/(200-50)\mu m$$

$$Ry=5\ \Omega\cdot m/10\ \mu m\times 50\ \mu m/100\ \mu m$$

When the withstand discharge test was performed by deteriorating a degree of vacuum of the inside by using an image displaying apparatus which used this light emitter substrate, a fact that the discharge current was reduced to a level equal to or less than 1 A was confirmed. A secondary discharge by the potential difference to be occurred between the metal back layers 2 separated in the row and column directions was not occurred. A point defect is not also occurred at a discharge spot, and a condition before the discharge can be maintained. In addition, the anode potential drop when an image forming apparatus is driven reaches a level equal to or less than 250V, and there was no problem also about the luminance deterioration on a visual confirmation.

As described above, the withstand discharge performance of the light emitter substrate having the constitution which can be manufactured by a process suitable for the commercial production and an image displaying apparatus of using this light emitter substrate could be confirmed.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-156665, filed Jun. 16, 2008, which is hereby incorporated by reference herein in its entirety.

What is claimed is:

1. A light emitter substrate comprising:

a substrate;

plural light emitting members which are positioned in matrix on the substrate;

plural electrodes each of which comprises a principal portion (S2) which covers at least one of the light emitting members and a connecting portion (S1) which is placed to meet to the principal portion in a column direction so as to form a cross shape; and a row-direction striped resistor which is positioned between the electrodes adjacent to each other in a column direction and connects the electrodes adjacent to others in a row direction and the column direction by connection with the connection portions, wherein a row-direction separated distance between the electrodes adjacent to each other in the row direction at the connecting portion is larger than a row-direction separated distance between the electrodes adjacent to each other in the row direction at the principal portion.

2. An image displaying apparatus comprising:

a rear plate substrate having plural electron-emitting devices; and a light emitter substrate described in claim 1, wherein light emitting members of the light emitter substrate emit light in response to electrons emitted from the electron-emitting devices.

* * * * *